US008282741B2

(12) United States Patent
Bertsch et al.

(10) Patent No.: US 8,282,741 B2
(45) **Date of Patent: *Oct. 9, 2012**

(54) SEQUENCING SPRAY ARM ASSEMBLY FOR A DISHWASHER

(75) Inventors: Roger J. Bertsch, Stevensville, MI (US); Rayburn L. Cox, Bridgman, MI (US); Bruce W. Gillum, Kalamazoo, MI (US); Bernhard Mohrbacher, Schonenberg-Kubelberg (DE); Donald J. Wilson, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1003 days.

This patent is subject to a terminal disclaimer.

(21) Appl. No.: 12/193,823

(22) Filed: Aug. 19, 2008

(65) Prior Publication Data

US 2010/0043826 A1 Feb. 25, 2010

(51) Int. Cl.
*B08B 7/00* (2006.01)
*A47L 15/42* (2006.01)
*A47L 15/46* (2006.01)

(52) U.S. Cl. ..... 134/18; 134/199; 134/56 D; 134/172

(58) Field of Classification Search ..... 134/56 D, 134/57 D, 58 D, 144, 148, 151, 172, 199, 134/200, 18

See application file for complete search history.

(56) References Cited

U.S. PATENT DOCUMENTS

| | | | | |
|---|---|---|---|---|
| 1,345,519 | A | 7/1920 | Vaudreuil | |
| 1,408,077 | A | 2/1922 | Clinton | |
| 1,592,452 | A * | 7/1926 | Ferris et al. | 239/227 |
| 2,275,189 | A | 3/1942 | Wieghart | |
| 3,095,885 | A | 7/1963 | Hertell | |
| 3,468,486 | A | 9/1969 | Mercer | |
| 3,496,949 | A | 2/1970 | Mercer | |
| 3,648,931 | A | 3/1972 | Jacobs | |
| 3,677,473 | A | 7/1972 | Belaieff | |
| 4,509,687 | A | 4/1985 | Cushing | |
| 5,449,011 | A | 9/1995 | Jacobus et al. | |
| 5,464,482 | A | 11/1995 | Michael et al. | |
| 5,577,665 | A * | 11/1996 | Chang | 239/256 |
| 5,579,789 | A | 12/1996 | Spiegel | |
| 5,848,610 | A | 12/1998 | Livernash et al. | |
| 6,959,881 | B2 | 11/2005 | Kim | |
| 7,896,977 | B2 * | 3/2011 | Gillum et al. | 134/56 D |

(Continued)

FOREIGN PATENT DOCUMENTS

| | | |
|---|---|---|
| DE | 1403670 | 10/1968 |

(Continued)

*Primary Examiner* — Michael Barr
*Assistant Examiner* — Benjamin Osterhout
(74) *Attorney, Agent, or Firm* — Jaquelyn Lin; Diederiks & Whitelaw PLC

(57) ABSTRACT

A sequencing spray arm assembly includes a plurality fluid spray arms rotatably mounted on respective radially spaced carrier arms. The rotating fluid spray arms are in fluid communication with a fluid distribution manifold and adapted to distribute washing fluid throughout a washing chamber of the appliance. A sequencing diverter valve system enables delivery of washing fluid from the fluid distribution manifold to one or more of the plurality of rotating fluid spray arms. A fluid responsive rotating drive arm drives the rotation of a sequencing disk in the valve system between discrete positions and enables delivery of fluid to one or more of the plurality of rotating fluid spray arms in a sequential manner such that, for each discrete position, less than the total number of spray arms are supplied with washing fluid at a time.

17 Claims, 6 Drawing Sheets

U.S. PATENT DOCUMENTS

| | | | | |
|---|---|---|---|---|
| 7,914,625 | B2 * | 3/2011 | Bertsch et al. | 134/25.2 |
| 2004/0255982 | A1 * | 12/2004 | VanderRoest et al. | 134/25.2 |
| 2004/0255992 | A1 | 12/2004 | Eiermann | |
| 2005/0011544 | A1 | 1/2005 | Rosenbauer et al. | |
| 2005/0039777 | A1 | 2/2005 | Jerg et al. | |
| 2005/0133070 | A1 * | 6/2005 | Vanderroest et al. | 134/56 D |
| 2005/0150529 | A1 * | 7/2005 | Vanderroest et al. | 134/135 |
| 2006/0054198 | A1 * | 3/2006 | Choi | 134/56 D |
| 2007/0017556 | A1 * | 1/2007 | VanderRoest et al. | 134/56 D |
| 2009/0159103 | A1 * | 6/2009 | Gillum et al. | 134/98.1 |

FOREIGN PATENT DOCUMENTS

| | | |
|---|---|---|
| JP | 4122351 | 4/1992 |
| JP | 4164427 | 6/1992 |
| JP | 4164429 | 6/1992 |
| JP | 4279134 | 10/1992 |

* cited by examiner

SEQUENCING SPRAY ARM ASSEMBLY FOR A DISHWASHER

BACKGROUND OF THE INVENTION

1. Field of the Invention

The present invention pertains to the art of dishwashers and, more specifically, to spray arm arrangements for dishwashers.

2. Description of the Related Art

Dishwashers are provided with internal spraying devices for directing streams of washing liquid at objects to be washed. More specifically, a dishwasher includes a washing chamber having a bottom sump in fluid communication with a motor driven pump to supply washing liquid under pressure to a spraying device that directs streams of washing liquid at dishes held in the washing chamber. As is known, the streams of washing liquid generally flow from one or more rotatable wash arms due to the effect of reactions caused by fluid jets coming out of respective pressure nozzles. It is also known to provide a dishwasher with fixed spray nozzle units.

Typically, the number of spray arms fed by a pump is limited by available water pressure in the dishwasher system. A drop in pressure within the system may reduce the intensity of the water jets, thus reducing cleaning power. Additionally, effective washing at the corners of a square wash rack is difficult to accomplish with standard spray arm configurations. In one proposed solution set forth in U.S. Patent Application Publication No. 2005/0011544, a dishwasher system allows a user to select particular quadrants of the dishwasher for more intense washing. More specifically, a control selectively operates a valve to block fluid to selected spray arms. Additionally, the speed of the circulating pump motor may be changed, thus altering the exit rate of water jets. However, such a system requires specific controls, and multiple supply lines to respective spray arms. Further, the rate of travel for a particular rotating arm is generally dictated by the pressure of the water jets issuing from the arms. Therefore, increasing the speed of the circulating pump not only increases water jet intensity, but reduces the dwell time, or the time water is impinging on articles in the dishwasher. Conversely, reducing the speed of the circulating pump decreases water jet intensity, but increases dwell time.

In any case, there is considered to be a need in the art for a dishwasher system having multiple wash arms for effective cleaning throughout a dishwasher, wherein the system allows for zone washing without sacrificing jet intensity or dwell time.

SUMMARY OF THE INVENTION

The present invention is directed to a dishwasher and, more specifically, to a dishwasher including a sequencing spray arm assembly which provides improved wash performance through increased wash intensity and improved spray coverage. In general, the sequencing spray arm assembly includes a plurality fluid spray arms rotatably mounted on respective radially spaced carrier arms. The rotating fluid spray arms are in fluid communication with a fluid distribution manifold and are adapted to distribute jets of washing fluid throughout a dishwasher chamber and into the corners of the chamber. A sequencing diverter valve system enables sequential delivery of washing fluid from the fluid distribution manifold to one or more of the plurality of rotating fluid spray arms. More specifically, fluid is fed from the water distribution manifold to a fluid responsive rotating drive arm operatively connected to a sequencing disk. The flowing fluid actually drives the rotation of the drive arm which, preferably through a gear train, drives the rotation of the sequencing disk between discrete positions. In this manner, the sequencing disk acts as a valve to open and close inlets in fluid communication with the fluid spray arms. The number of spray arms that receive washing fluid at any given time is thus dictated by the rotational position of the sequencing disk. In this manner, the sequencing spray arm assembly provides increased jet intensity by limiting the number of spray arms which operate at one time, without sacrificing dwell time.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
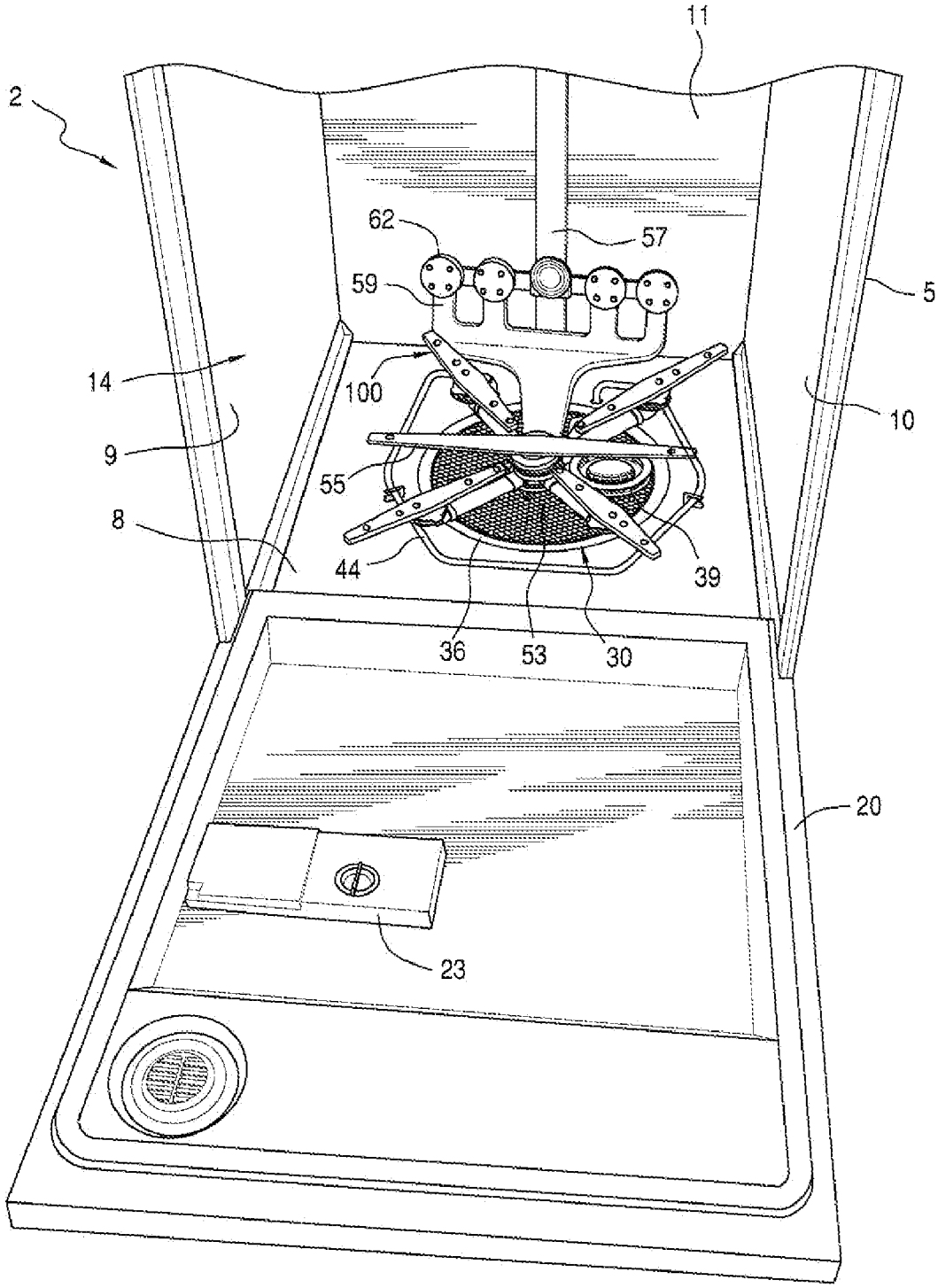
FIG. 1 is a partial perspective view of a dishwasher including a sequencing spray arm assembly constructed in accordance with the present invention.
Figure 2:
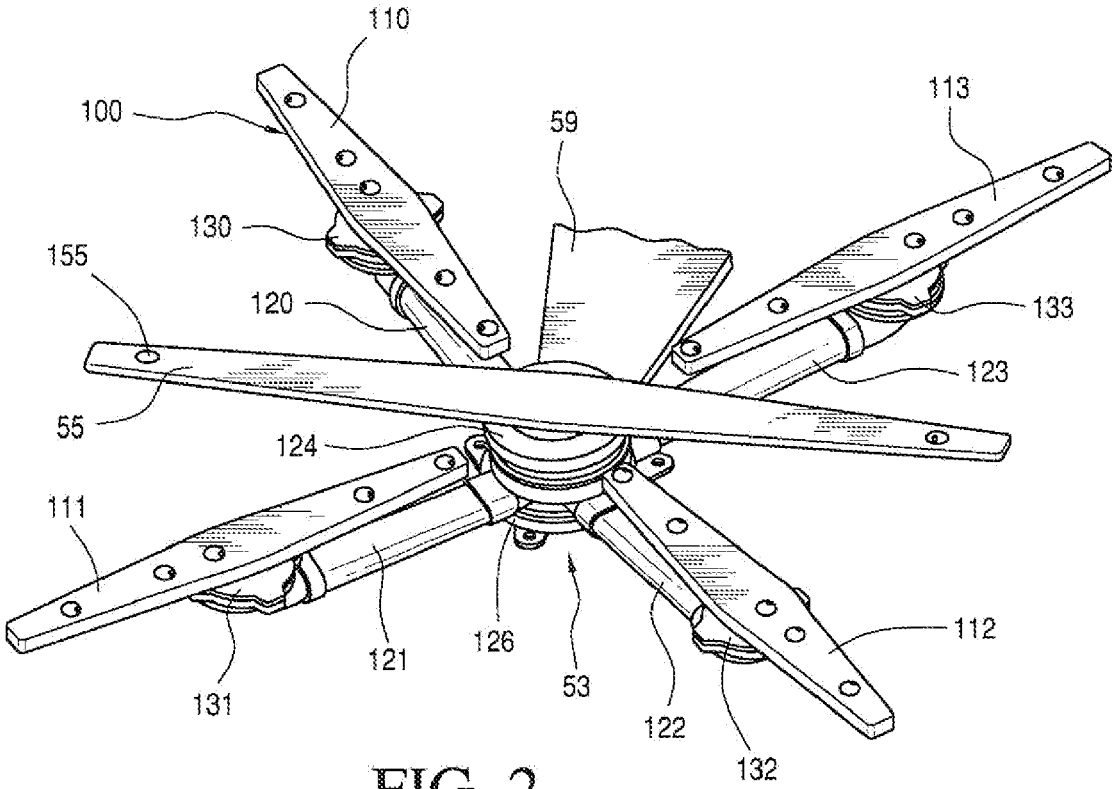
FIG. 2 is a perspective view of the sequencing spray arm assembly of FIG. 1.

With initial reference to FIGS. 1 and 2, a dishwasher constructed in accordance with the present invention as generally indicated at 2. As shown, dishwasher 2 includes a tub 5 which is preferably molded of plastic so as to include integral bottom, side, and rear walls 8-11 respectively, as well as a top wall (not shown). Tub 5 defines a washing chamber 14 within which soiled kitchenware is adapted to be placed upon shiftable upper and lower racks (not shown for drawing clarity), with the kitchenware being cleaned during a washing operation. Tub 5 has attached thereto a pivotally supported door 20 used to seal chamber 14 during the washing operation. In connection with the washing operation, door 20 is preferably provided with a detergent tray assembly 23 within which a consumer can place liquid or particulate washing detergent for dispensing at predetermined portions of the washing operation. Of course, dispensing detergent in this fashion is known in the art such that this arrangement is only being described for the sake of completeness.

Disposed within tub 5 is a filtration system generally indicated at 30. In the preferred embodiment, filtration system 30 includes a central main strainer or filter screen 36 and a secondary strainer 39. Extending about a substantial portion of filtration system 30, at a position raised above bottom wall 8, is a heating element 44. In a manner known in the art, heating element 44 preferably takes the form of a sheath, electric resistance-type heating element.

Dishwasher 2 further includes a fluid distribution system including a circulation pump (not shown) adapted to direct washing fluid from a sump (not shown) to a fluid distribution manifold indicated at 53 in a manner known in the art. Fluid distribution manifold 53 supplies washing fluid to a fluid response rotatable drive spray arm 55 and a conduit 57 leading to at least one upper spray unit (not shown). Additionally, fluid distribution manifold 53 may be in fluid communication with a spray manifold assembly 59 including a plurality of rotating spray disks 62. Basically, the above description of dishwasher 2 has been provided for the sake of completeness as the present invention is particularly directed to a sequencing spray arm assembly 100 utilized in conjunction with a sequencing diverter valve system 102 (see FIG. 3), as will now be described in more detail below.

As best seen in FIG. 2, sequencing fluid distribution or spray arm assembly 100 includes first, second, third and fourth fluid propelled rotating spray arms 110-113 in fluid communication with fluid distribution manifold 53 via respective radially extending and circumferentially spaced elongated carrier arms 120-123. Drive arm 55 is rotatably connected to a central, main support housing 124 of fluid distribution manifold 53 via a hub 125 (depicted in FIG. 3), while carrier arms 120-123 are rotatably mounted to fluid distribution manifold 53 at a hub 126 of a lower, fluid chamber defining housing 127. Rotating spray arms 110-113 are independently, rotatably mounted at a distal end of carrier arms 120-123 by respective hubs 130-133. In accordance with the invention, this configuration allows for washing fluid distribution throughout washing chamber 14, including corners which are out of reach of typical spray arms.

Figure 3:
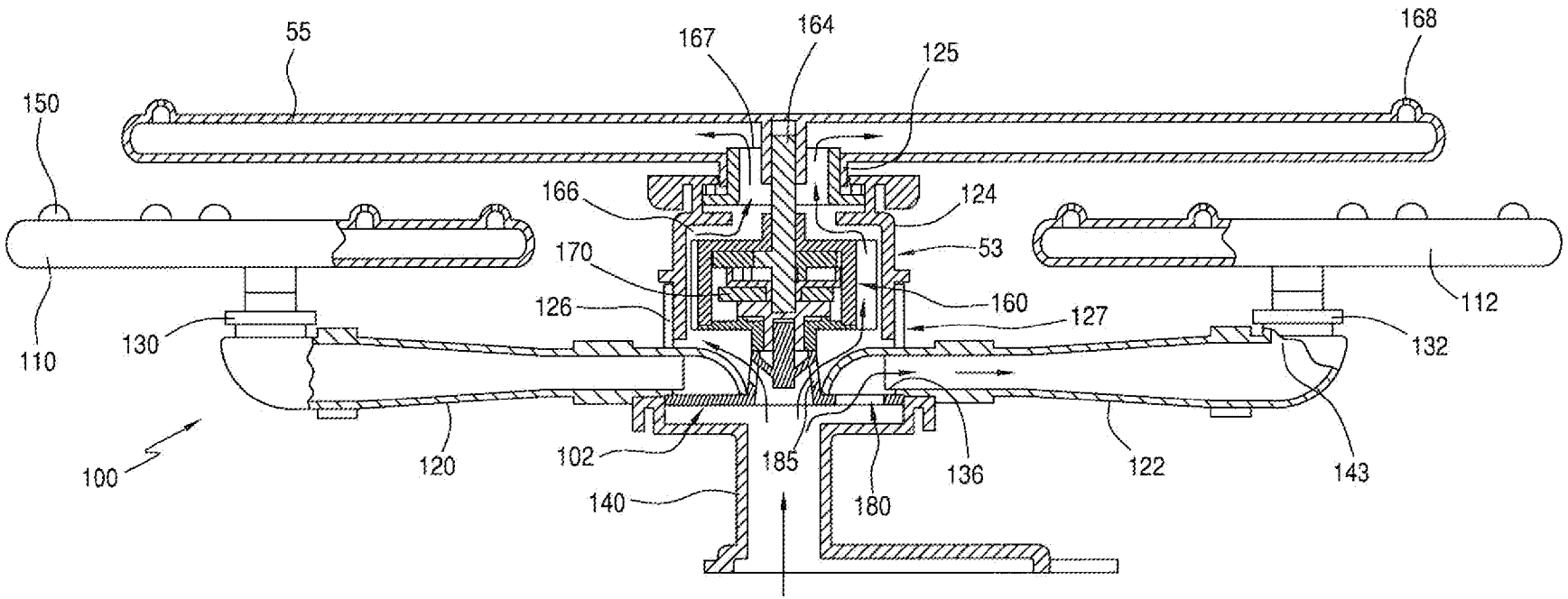
FIG. 3 is a partial cross-sectional side view of the sequencing lower spray arm assembly of FIG. 2.

As best illustrated in FIG. 3, carrier arms 120-123 are hollow and are in fluid communication with lower housing 127 via fluid outlets 136 in lower housing 127. A supply line 140 delivers fluid to housing 127 via a recirculating pump (not shown). Carrier arms 120-123 also include respective outlets 143 in fluid communication with one of the respective rotating spray arms 110-113. A plurality of nozzles 150 are provided on spray arms 110-113 and configured to direct jets of fluid throughout washing chamber 14. At least one nozzle 150 on each spray arm 110-113 directs a jet of fluid in a direction for thrusting the respective spray arm 110-113 to rotate, preferably in a common rotational direction. Spray arms 110-113 are preferably made of plastic and are relatively short in length, thereby being light compared to typical spray arms, such that less energy is needed to rotate spray arms 110-113 during a wash cycle. In one embodiment of the invention, jets of fluid from the at least one nozzle 150 are directed at a relative high acute angle with respect to dishwasher walls 8-11, thereby reducing noise from impinging jets of fluid which would be otherwise directed at a more horizontal or low acute angle to supply a sufficient rotational force to spray arms 110-113. Although depicted as including five nozzles each, spray arms 110-113 may be provided with more or fewer nozzles as desired. In the preferred embodiment shown, spray arms 110-113 operate on the same plane and are sized such that they can rotate freely without interference within washing chamber 14 while just missing each other, side and rear walls 9-11 and door 20. With this configuration spray arms 110-113 provide washing fluid throughout washing chamber 14 so as to provide enhanced spray distribution and better corner washability.

In accordance with the present invention, spray arms 110-113 are driven in a sequential manner utilizing sequencing diverter valve system 102. Advantageously, small sequencing spray arms 110-113 utilizes less water compared to a single large prior art spray arm, with only one or two of arms 110-113 being operated at a given time. Further, by operating only one or two of spray arms 110-113 at a time, water pressure in spray arms 110-113 is increased, while the fluid flow rate through the system is reduced as compared to a conventional spray arm.

Figure 4:
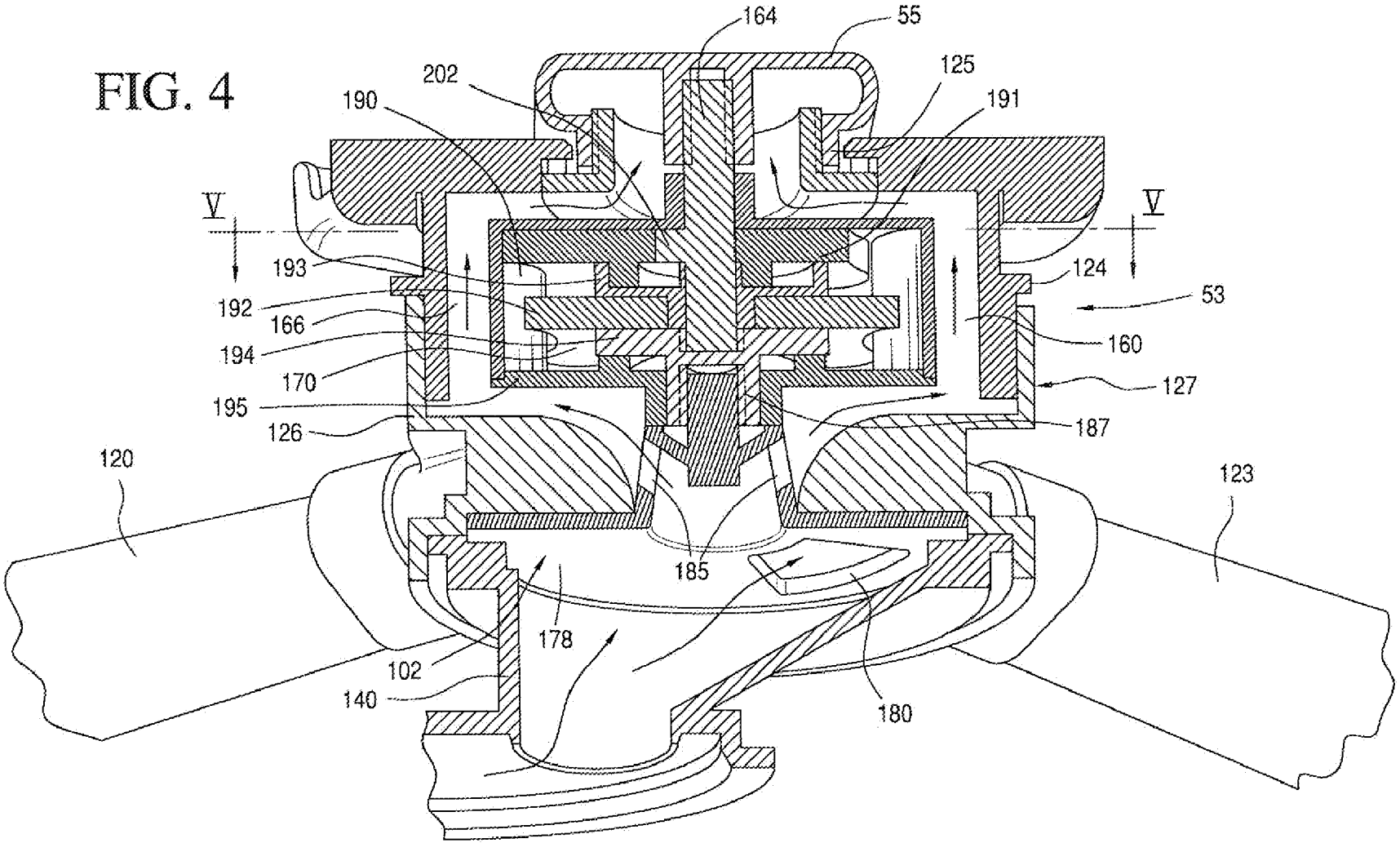
FIG. 4 is a partial cross-sectional perspective view of a sequencing gear train assembly utilized in accordance with the present invention.

Sequencing diverter valve system 102 of the present invention will now be discussed in more detail with reference to FIGS. 3 and 4. Sequencing diverter valve system 102 utilizes a reduction train or sequencing gear assembly 160. In accordance with a novel aspect of the present invention, drive arm 55 is connected to gear assembly 160 housed in fluid distribution manifold 53 by a drive shaft 164. In use, fluid flows upward through an annular channel 166 in fluid distribution manifold 53 through an upper outlet 167 and into drive arm 55. Fluid exits drive arm 55 through at least one nozzle 168 adapted to direct jets of fluid in a direction for driving the rotation of drive arm 55 in a common direction to spray arms 110-113, and causing the concurrent rotation of drive shaft 164. In turn, drive shaft 164 drives an epicyclical gear train 170 of sequencing gear assembly 160. Gear train 170 includes an output shaft 175 connected to a sequencing valve, shown in the form of a disk 178, located between fluid supply line 140 and fluid distribution manifold 53.

Sequencing disk 178 includes at least one opening 180 and, in use, acts as a valve to open and close respective inlets 181-184 (seen best in FIG. 6) in a bottom wall of lower housing 127. Each inlet 181-184 is in communication with a respective carrier arm 120-123. In other words, sequencing disk 178 is adapted to sequentially block multiple ones of the plurality of respective inlets 181-184 to lower housing 127 and thus to sequentially direct fluid through outlets 136 into respective carrier arms 120-123 by rotating sequencing disk 178 through a plurality of discrete rotational positions. Therefore, washing liquid from fluid supply line 140 is directed through one or more ports 180 in sequencing disk 178 into lower housing 127, and through respective outlets 136 into one or more carrier arms 120-123.

At this point, it should be understood that the carrier arm or arms that receive washing liquid from fluid supply line 140 depends on the rotational position of sequencing disk 178. In FIG. 3, for example, sequencing disk 178 is in a first rotational position wherein a fluid stream is directed through port 180 into carrier arm 122 of spray arm 112. In FIG. 4, sequencing disk 178 is in a second rotational position wherein a fluid stream is directed through port 180 into carrier arm 123 of spray arm 113. In this configuration, fluid in spray arm 113 exits nozzles 150 and drives the rotation of spray arm 113. In accordance with the invention, fluid would next be supplied to adjacent carrier arm 120 when sequencing disk 178 is rotated to a third rotational position (not shown). Washing fluid not directed to one or more carrier arms 120-123 is directed through apertures 185 in sequencing disk 178 into channels 166 as secondary fluid streams, and through channels 166 to drive arm 55, wherein drive arm 55 is powered by washing liquid exiting drive arm 55 through nozzles 168.

Gear train 170 allows for a sufficient dwell time of sequencing disk 178 at each rotational position so as to supply sufficient wash fluid to a particular spray arm 110-113 or group of spray arms (e.g., 110 and 112 depending on the number and relative positions of ports 180 provided in disk 178) in a sequential manner. At this point, it should be realized that various different types of gearing reduction driving systems could be employed to establish a desired dwell time based on the rotation of drive arm 55. In the preferred embodiment shown, gear train 170 is a epicyclical gear train which provides for a rotational ratio of 36 to 1 between drive arm 55 and sequencing disk 178. That is, for every thirty six rotations of drive arm 55, gear train 170 will rotate sequencing disk 178 one rotation. However, it should be understood that the dwell time of sequencing disk 178 in each rotational position can be readily altered by altering the gear ratio of gear train 170.

Figure 5:
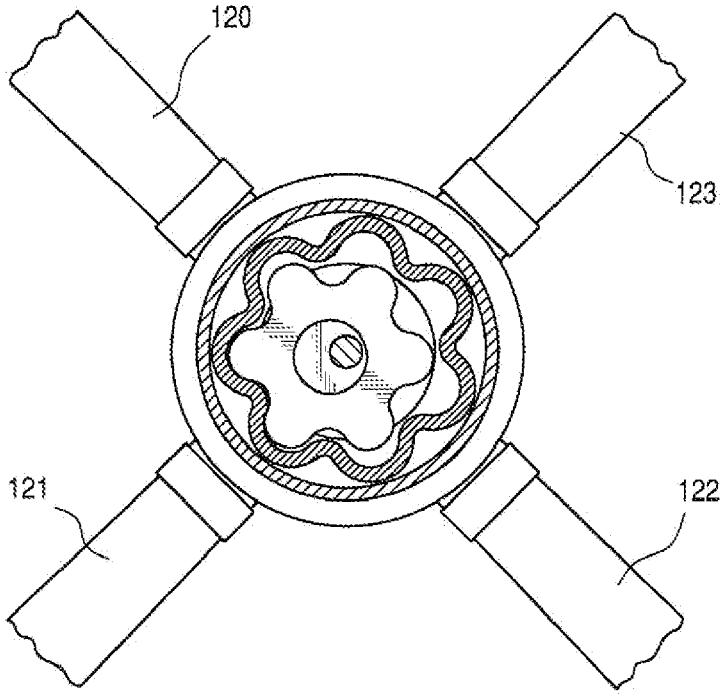
FIG. 5 is a top partial cross-sectional view of the sequencing gear train assembly of FIG. 4.
Figure 6:
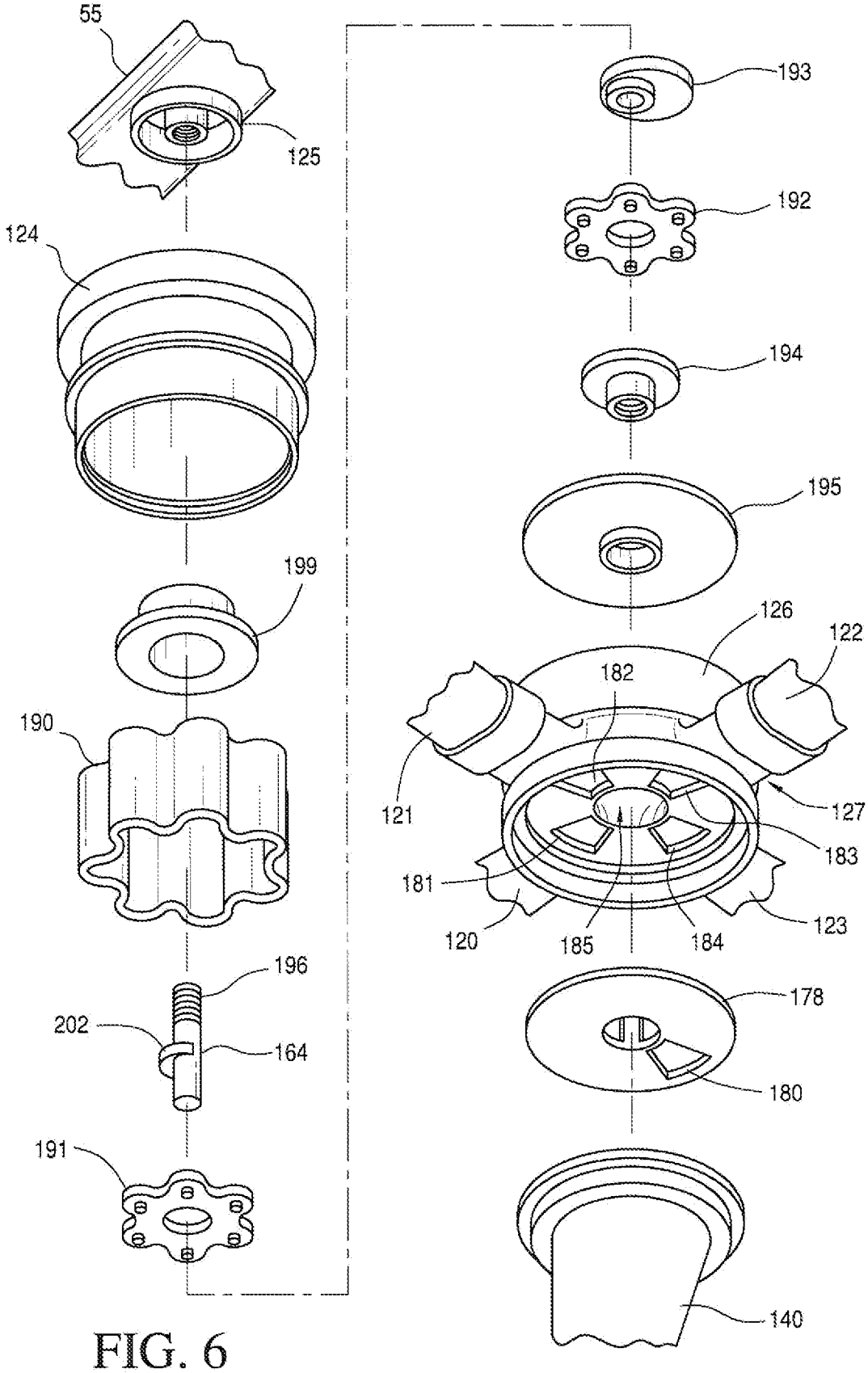
FIG. 6 is an exploded partial perspective view of the sequencing gear train assembly of FIG. 4.

The manner in which gear train 170 connects to sequencing disk 178 and drive arm 55 will now be discussed in more detail with reference to FIGS. 3, 5 and 6. In general, gear train 170 comprises drive shaft 164, a stationary epicyclical gear 190, first and second epicyclical gears 191 and 192, a gear carrier 193 and an output shaft 194 adapted to extend through a lower housing cover 195. As depicted in FIG. 6, first and second epicyclical gears 191 and 192 include pins (not separately labeled) to engage the respective gear carrier 193 and output shaft 194. During assembly, a threaded portion 196 of drive shaft 164 extends through an opening in stationary epicyclical gear 190, an opening in an insert 199 and an opening in main housing 124 to connect to hub 125 of drive arm 55. A drive lever 202 extending from drive shaft 164 is adapted to abut an upper wall of main housing 124 and operatively engage epicyclical gear 191. The remaining components of gear train 170 are retained within main housing 124 by lower housing cover 195. Output shaft 194 extends through a central opening of housing cover 195 and operatively engages sequencing disk 178. As the rotational force of drive arm 55 is transferred through gear assembly 160 to sequencing disk 178, sequencing disk 178 is rotated through multiple rotational positions to allow fluid to sequentially enter respective openings 126 in carrier arms 120-123.

Figure 7:
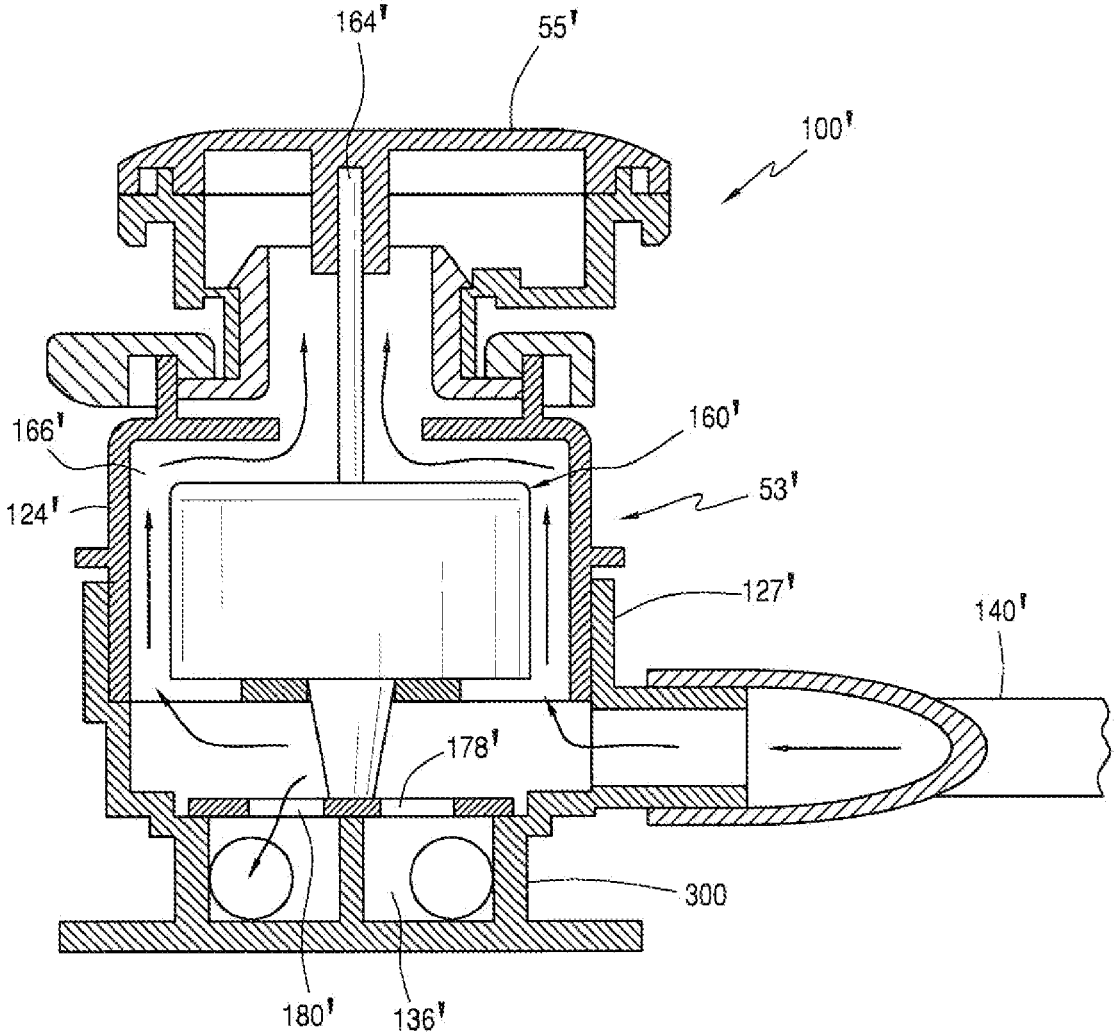
FIG. 7 is a partial cross-sectional perspective view of an alternative embodiment of the sequencing lower spray arm assembly of the present invention.

As should be readily understood from the above description, washing fluid is supplied to sequencing spray arm assembly 100 from below sequencing disk 178. In an alternative embodiment, a sequencing disk 178' having ports 180' is located below a fluid supply line 140'. This alternative spray arm assembly 100' will now be discussed with reference to FIG. 7. As in the previous embodiment, a drive arm 55' is operatively connected to a sequencing gear assembly 160' housed in a fluid distribution manifold 53' by a drive shaft 164'. However, in this alternative arrangement, a lower housing 127' includes a fluid distribution manifold 300 in communication with additional spray arms (not shown) located below fluid supply line 140' and sequencing disk 178'. In the manner discussed above, the rotational force of drive arm 55' is transferred through gear assembly 160' to sequencing disk 178', and sequencing disk 178' is rotated through a sequence of rotational positions to allow fluid to flow through one or more ports 180' in sequencing disk 178'. In this embodiment, each port 180' is connected to a respective lower spray arm (not shown) through lower fluid outlets 136'. As shown, two ports 180' and, thus, two spray arms (not shown), are supplied with fluid for each rotational position of sequencing disk 178'. Washing fluid not directed to lower housing 127' flows into channel 166' defined within a housing 124' as secondary fluid streams, and through channel 166' to drive arm 55', wherein drive arm 55' is powered by washing liquid exiting drive arm 55' and functions to rotate drive shaft 164'.

Advantageously, the present system provides extended reach of washing fluid into the corners of the dishwasher, resulting in more flexible dish loading options and better corner washability. Additionally, sequencing of the lower arms allows for the potential to reduce the fill amount and to save energy. The reduced flow rate through the small arms results in less fluid noise. Further, the nozzles on the small arm ends may be angled in a more vertical direction, minimizing sound generated by fluid impacting the sides of the dishwasher tub. Pressure increases in each individual small arm, resulting in reduced flow rate and increased pressure over a conventional spray arm. The result is a system having improved wash performance through increased wash intensity and improved coverage.

Although described with reference to preferred embodiments of the invention, it should be readily understood that various changes and/or modifications can be made to the invention without departing from the spirit thereof. For instance, although four lower spray arms are depicted, it should be understood that the actual number employed may vary in accordance with the present invention. In general, the invention is only intended to be limited by the scope of the following claims.

What is claimed is:

1. A dishwasher comprising:

a tub defining a washing chamber for receiving articles to be washed;

a door attached to the tub for selectively sealing the washing chamber;

a fluid supply line; and a sequencing spray arm assembly comprising:

a fluid distribution manifold in communication with the fluid supply line;

spaced first and second elongated carrier arms in fluid communication with said fluid distribution manifold;

first and second rotatable spray arms in fluid communication with the first and second carrier arms respectively;

at least one nozzle located on each of the first and second spray arms configured to deliver a jet of washing fluid into the washing chamber;

a sequencing diverter valve system including a sequencing valve, wherein the sequencing diverter valve system is configured to enable sequential delivery of washing fluid from the fluid distribution manifold to the first and second carrier arms; and a fluid responsive rotating drive arm in fluid communication with the fluid distribution manifold and including at least one nozzle for directing a spray of washing fluid into the wash chamber, said rotating drive arm being operatively connected to the sequencing valve to drive the sequencing valve between at least first and second, discrete positions for sequential delivery of washing fluid to the first and second spray arms respectively.

2. The dishwasher of claim 1, wherein the sequencing diverter valve system is configured to deliver washing fluid from the fluid distribution manifold to the first carrier arm but not the second carrier arm when the sequencing valve is in the first position, and to deliver washing fluid from the fluid distribution manifold to the second carrier arm but not the first carrier arm when the sequencing valve is in the second position.

3. The dishwasher of claim 1, wherein the first and second spray arms are rotatably supported by the first and second elongated carrier arms, respectively.

4. The dishwasher of claim 1, wherein the sequencing valve is in the form of a disk.

5. The dishwasher of claim 1, wherein the sequencing diverter valve system further comprises means for rotating the drive arm through multiple revolutions before shifting the sequencing valve from the first position to the second position.

6. The dishwasher of claim 1, wherein the sequencing spray arm assembly further comprises:

third and fourth elongated carrier arms in fluid communication with said fluid distribution manifold and circumferentially spaced from one another and the first and second elongated carrier arms in the washing chamber;

third and fourth spray arms attached to and in fluid communication with respective third and fourth carrier arms, wherein the sequencing diverter valve system is configured to allow sequential delivery of washing fluid from the fluid distribution manifold to the first, second, third and fourth carrier arms; and at least one nozzle located on each of the third and fourth spray arms configured to deliver a jet of washing fluid into the washing chamber.

7. The dishwasher of claim 6, wherein the third and fourth spray arms are fluid propelled and rotatably supported by the third and fourth elongated carrier arms, respectively.

8. The dishwasher of claim 6, wherein the sequencing diverter valve system is configured to allow delivery of washing fluid from the fluid distribution manifold to the first and second carrier arms when the sequencing valve is in the first position, and to third and fourth carrier arms when the sequencing valve is in the second position.

9. The dishwasher of claim 6, wherein the first, second, third and fourth spray arms are rotating spray arms arranged in the washing chamber so as to miss touching one another and the tub when rotating.

10. The dishwasher of claim 1, wherein the fluid supply line directs washing fluid into the fluid distribution manifold from below the sequencing valve.

11. The dishwasher of claim 1, wherein the fluid supply line is directs washing fluid into the fluid distribution manifold from above the sequencing valve.

12. In a dishwasher including:

a tub defining a washing chamber for receiving articles to be washed;

a door attached to the tub for selectively sealing the washing chamber;

a fluid supply line; and a sequencing spray arm assembly comprising:

a fluid distribution manifold in communication with the fluid supply line;

spaced first and second elongated carrier arms in fluid communication with said fluid distribution manifold;

a plurality of spray arms including first and second rotatable spray arms in fluid communication with the first and second carrier arms respectively;

at least one nozzle located on each of the first and second spray arms configured to deliver a jet of washing fluid into the washing chamber;

a sequencing diverter valve system including a sequencing valve, wherein the sequencing diverter valve system is configured to enable sequential delivery of washing fluid from the fluid distribution manifold to the first and second carrier arms; and a fluid responsive rotating drive arm in fluid communication with the fluid distribution manifold and including at least one nozzle for directing a spray of washing fluid into the wash chamber, said rotating drive arm being operatively connected to the sequencing valve to drive the sequencing valve between at least first and second, discrete positions for sequential delivery of washing fluid to the first and second spray arms respectively, a method for controlling fluid distribution in the dishwasher including the washing chamber comprising: supplying washing fluid from the fluid supply line to the fluid distribution manifold;

supplying the washing fluid from the fluid distribution manifold to the fluid responsive drive arm to cause the fluid responsive drive arm to rotate; and driving, based on the rotation of the drive arm, the sequencing valve between the first position wherein the washing fluid is further supplied from the fluid distribution manifold to one of the plurality of spray arms defined by the first spray arm and the second position wherein the washing fluid is supplied from the fluid distribution manifold to another one of the plurality of spray arms defined by the second spray arm.

13. The method of claim 12, further comprising:

supplying washing fluid to first and second ones of the plurality of spray arms when the sequencing valve is in the first position; and supplying washing fluid to a third and fourth ones of the plurality of spray arms when the sequencing valve is in the second position.

14. The method of claim 12, further comprising:

sequentially supplying washing fluid to first, second, third and fourth ones of the plurality of spray arms upon rotating the drive arm.

15. The method of claim 12, further comprising:

supplying the washing fluid from below the sequencing valve.

16. The method of claim 12, further comprising:

supplying the washing fluid from above the sequencing valve.

17. The method of claim 12, further comprising:

rotating the drive arm through multiple revolutions before shifting the sequencing valve from the first position to the second position.

* * * * *